US007530235B2

(12) United States Patent
Yamaguchi et al.

(10) Patent No.: US 7,530,235 B2
(45) Date of Patent: May 12, 2009

(54) HEAT PUMP, HEAT PUMP SYSTEM, METHOD OF PUMPING REFRIGERANT, AND RANKINE CYCLE SYSTEM

(75) Inventors: Hiroshi Yamaguchi, Kyoto (JP); Katsumi Fujima, Tsukuba (JP); Masatoshi Enomoto, Oyama (JP); Noboru Sawada, Tokyo (JP)

(73) Assignees: The Doshisha (JP); Mayekawa Mfg. Co. Ltd. (JP); Showa Denko K.K. (JP); Showa Tansan Co., Ltd. (JP); Yoshimura Construction Co., Ltd. (JP)

( * ) Notice: Subject to any disclaimer, the term of this patent is extended or adjusted under 35 U.S.C. 154(b) by 0 days.

(21) Appl. No.: 11/686,857

(22) Filed: Mar. 15, 2007

(65) Prior Publication Data

US 2007/0199323 A1 Aug. 30, 2007

Related U.S. Application Data

(63) Continuation of application No. PCT/JP2005/016834, filed on Sep. 13, 2005.

(30) Foreign Application Priority Data

Sep. 17, 2004 (JP) ..... 2004-272597

(51) Int. Cl.
*F25B 23/00* (2006.01)

(52) U.S. Cl. ..... 62/467; 62/513; 60/671

(58) Field of Classification Search ..... 62/160, 62/238.7, 277, 278, 324.1, 467, 469, 472, 62/510, 513; 417/274; 60/670
See application file for complete search history.

(56) References Cited

U.S. PATENT DOCUMENTS 3,368,364 A * 2/1968 Norton et al. ..... 62/117
4,103,493 A * 8/1978 Schoenfelder ..... 60/641.11

(Continued)

FOREIGN PATENT DOCUMENTS

JP 2003-232226 A 8/2003

(Continued)

OTHER PUBLICATIONS

Relevant Portion of International Search Report issued in International Application No.PCT/JP2005/016834, with mailing date Dec. 20, 2005.

*Primary Examiner*—Mohammad M Ali
(74) *Attorney, Agent, or Firm*—Rossi, Kimms & McDowell LLP

(57) ABSTRACT

A Rankine cycle system has a condenser, a heat pump connected to the condenser, a heat collecting device connected to the heat pump, and an expansion turbine connected to the heat collecting device and the condenser. The heat pump includes an expansion tank or closed vessel, a refrigerant supply conduit connected to the lower part of the expansion tank and to the condenser, and a refrigerant discharge conduit connected to the upper part of the expansion tank. An open/close valve is installed in the refrigerant supply conduit. A pressure regulating valve installed in the refrigerant discharge pipe opens when a pressure reaches a specified value or higher. A temperature regulating device can heat the refrigerant in the expansion tank to produce a refrigerant vapor of saturated temperature or higher, which vapor can be introduced into the heat collecting device.

15 Claims, 5 Drawing Sheets

U.S. PATENT DOCUMENTS 4,197,716 A * 4/1980 Nussbaum ..... 62/196.4
4,281,969 A * 8/1981 Doub, Jr. ..... 417/52
4,347,711 A * 9/1982 Noe et al. ..... 62/160
4,359,329 A * 11/1982 Willeitner ..... 55/320
5,050,400 A * 9/1991 Lammert ..... 62/278
5,056,327 A * 10/1991 Lammert ..... 62/151
5,542,266 A * 8/1996 Suzuki et al. ..... 62/469
6,619,057 B2 * 9/2003 Williamson et al. ..... 62/149
6,718,781 B2 * 4/2004 Freund et al. ..... 62/199
6,820,434 B1 * 11/2004 Gutheim et al. ..... 62/175
6,945,062 B2 * 9/2005 Chen et al. ..... 62/228.5

FOREIGN PATENT DOCUMENTS

JP 2004-036942 A 2/2004

* cited by examiner

| | Mass of Refrigerant introduced into Closed Vessel | Mass of Refrigerant Discharged from Closed Vessel | Temperature Range | Heat Quantity | Responsivity of Pressure Rise |
|---|---|---|---|---|---|
| Fully Filled with Refrigerant Vapor | 463 kg | 229 kg | 25→60°C | 170 kJ/kg | Slow |
| Fully Filled with Liquid Refrigerant | 705 kg | 242 kg | 25→31°C | 61 kJ/kg | Fast |

HEAT PUMP, HEAT PUMP SYSTEM, METHOD OF PUMPING REFRIGERANT, AND RANKINE CYCLE SYSTEM

The system also includes a heat collecting device (heating device) 5 that absorbs heat from outside, such as a solar heat collector and a steam boiler, and is connected to an expansion turbine 7 through an open/close valve 6. The system also includes a condenser 8 for receiving vapor refrigerant exhausting from the expansion turbine 7 and cooling the vapor refrigerant by a cooling apparatus 9 to liquefy the refrigerant. The expansion tank 2 and the condenser 8 are disposed such that the level of liquid refrigerant in the expansion tank 2 is lower than that in the condenser 8. The upper part of the expansion tank 2 is connected to the upper part, i.e., a vapor zone K as shown in FIG. 2 ,in the condenser via a path that branches from the upstream zone of the pressure regulating valve a2 and can include an electromagnetic valve s. A gas breeder pipe 10 having a relief valve 11 that opens when the expansion tank 2 is in a state fully filled with liquid refrigerant and its pressure reaches a specified value for letting out part of the liquid refrigerant in the expansion tank 2 to the condenser 8.

BACKGROUND

A liquid reservoir 30 can be provided in a zone downstream from the condenser 8 in the refrigerant introducing path as shown in FIG. 6, such that the surface level of the liquid refrigerant in the tank 2 is lower than that of the refrigerant in the liquid reservoir. By providing the liquid reservoir 30, the pressure corresponding to the difference between the surface levels is applied to the tank 2, which helps the flow of refrigerant from the condenser into the tank 2.

By disposing a plurality of the heat pumps 1 in parallel as shown in FIG. 5, and operating them such that cooling by the cooling apparatus C and heating by the heating apparatus H of the heat pumps are performed in a timed sequence (with time difference respectively in each heat pump), total flow of vapor refrigerant discharged from the heat pumps can be smoothed.

Accordingly, there remains a need for a way of pressurizing and transferring a refrigerant, such as in a Rankine cycle system, with a lower power consumption in comparison with mechanical pump, while increasing reliability thereof by using non-moving components, resulting in absence of mechanical loss. The present invention addresses this need.

SUMMARY OF THE INVENTION

The present invention relates to a heat pump, a heat pump system, a method of pumping refrigerant without using a mechanical pump, and a Rankine cycle system.

One aspect of the present invention is a heat pump. The heat pump can include a closed vessel or expansion tank, a refrigerant introduction path connected to the vessel at a lower part of the vessel, a valve disposed in the refrigerant introduction path, a refrigerant discharge path connected to the vessel at an upper part of the vessel, a pressure regulating valve disposed in the refrigerant discharge path that opens at a predetermined pressure, and a temperature regulating device for heating and cooling a refrigerant into the closed vessel.

The temperature regulating device can include a cooling apparatus disposed inside the closed vessel in the upper region of the closed vessel and a heating apparatus disposed inside the closed vessel in the lower region of the closed vessel. Alternatively, the temperature regulating device can regulate or switch flow of a hot fluid medium and a cold fluid medium through the closed vessel to heat or cool the refrigerant in the vessel.

A conduit can connect to the refrigerant discharge path or to the upper part of the closed vessel. A valve for decreasing the pressure in the closed vessel and allowing introduction of the refrigerant into the closed vessel can be provided in the conduit.

A liquid reservoir can be connected to the refrigerant introduction path and disposed such that the surface level of the liquid refrigerant in the closed vessel is lower than that of the liquid refrigerant in the liquid reservoir. Introduction of liquid refrigerant into the closed vessel can be made easier by the liquid pressure corresponding to the difference in liquid levels between the liquid refrigerant in the liquid reservoir and that in the closed vessel.

Another aspect of the present invention is a heat pump system comprising a plurality of the above-described heat pumps connected in parallel. The plurality of heat pumps allow cooling and heating of the refrigerant in the closed vessel by operating the heat pumps in a timed sequence so that the total flow of refrigerant vapor discharged from the discharge from the heat pumps is run smoothly.

Another aspect of the present invention is a method of pumping refrigerant. The method includes providing the closed vessel, the refrigerant introducing path at the lower part of the vessel, the open/close valve in the refrigerant introduction path, the refrigerant discharge path at the upper part of the vessel, the pressure regulating valve in the refrigerant discharge path that opens at a predetermined pressure, and the temperature regulating device for heating and cooling the refrigerant in the closed vessel. The liquid refrigerant is introduced into the closed vessel through the refrigerant introduction path by reducing the pressure inside the closed vessel. This is achieved by cooling the refrigerant in the closed vessel to below its saturation temperature. The refrigerant in the closed vessel is discharged through the refrigerant discharge path when the pressure in the closed vessel reaches the predetermined pressure. This is achieved by vaporizing the refrigerant in the closed vessel by heating the same. The vapor refrigerant in the closed vessel is discharged through the pressure-regulating valve, which opens at a specified pressure to be supplied to a device in the downstream zone, such as a heat collecting device.

After the vapor refrigerant is discharged from the closed vessel, the refrigerant remaining in the closed vessel is cooled to lower the pressure in the closed vessel, which results in the liquid refrigerant being introduced into the closed vessel through the refrigerant introduction path.

Another aspect of the present invention is a Rankine cycle system that uses the above-described heat pump. The system includes a condenser, the heat pump connected to the condenser, a heat collecting device connected to the heat pump, and an expansion turbine connected to the heat collecting device and the condenser so that a refrigerant is introduced from the heat collecting device to the turbine to allow the turbine to output work. The refrigerant introduction path is connected to the vessel and the condenser. The refrigerant discharge path is connected to the vessel and the heating device.

When introducing liquid refrigerant from the condenser to the closed vessel, the open/close valve is opened to allow the condenser to be communicated with the closed vessel and equalize pressure in the condenser and the closed vessel, by which the refrigerant in the condenser is introduced into the closed vessel, and then the refrigerant in the closed vessel is cooled and decreased in pressure, thereby further sucking the refrigerant in the condenser into the closed vessel.

A gas phase zone in the condenser is communicable with a gas phase zone in the closed vessel when the open/close valve is opened.

The above-described heat pump system can be used to smooth the total flow of refrigerant discharged from the heat pumps.

DETAILED DESCRIPTION

Preferred embodiments of the present invention will now be detailed with reference to the accompanying drawings. It is intended, however, that unless particularly specified, dimensions, materials, relative positions and so forth of the constituent parts in the embodiments are to be interpreted as illustrative only, not as limiting the scope of the present invention.

Figures 1, 2:
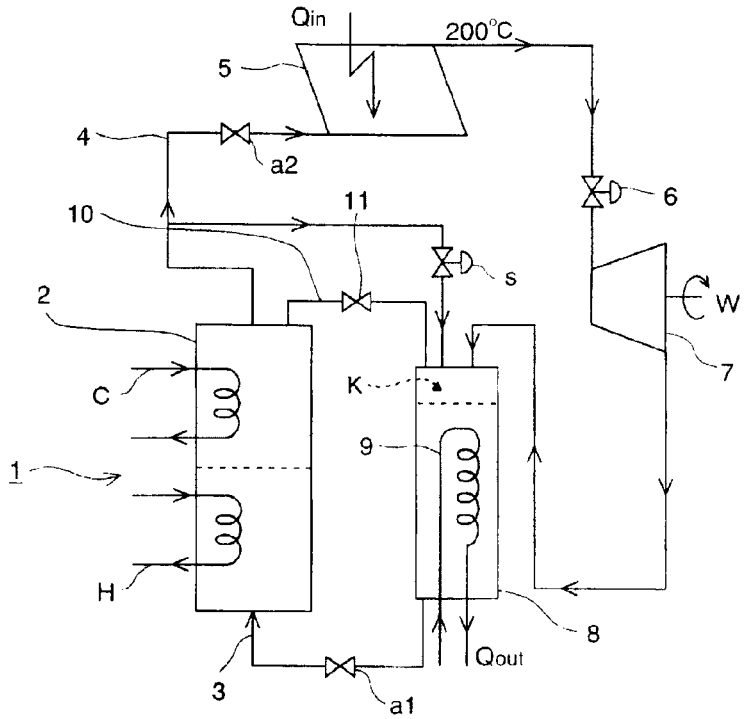
FIG. 1 is a table showing properties of heated $CO_2$ refrigerant in a closed vessel.
FIG. 2 is a schematic diagram of one embodiment of a transcritical Rankine system using $CO_2$ as a refrigerant.
Figure 3:
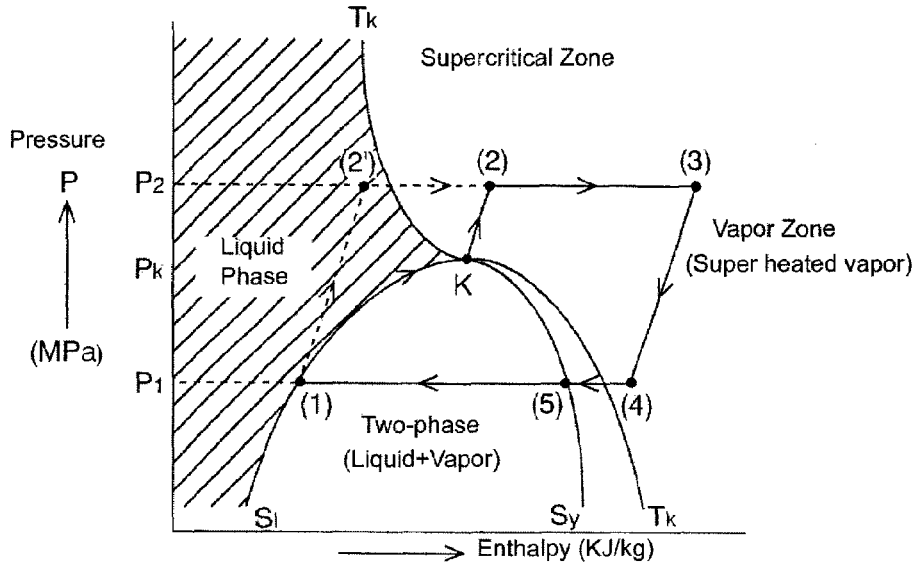
FIG. 3 is a pressure-enthalpy diagram of the transcritical Rankine system of FIG. 2.

FIG. 2 is a schematic diagram of one embodiment of a transcritical Rankine cycle system using $CO_2$ as a refrigerant, and FIG. 3 is a pressure-enthalpy diagram thereof. The system includes a heat pump 1 comprising a closed expansion tank or vessel 2, a refrigerant introduction path 3, such as a conduit, connected to the lower part of the expansion tank 2, and a refrigerant discharge path 4, such as a conduit, 4 connected to the upper part of the expansion tank 2. The refrigerant introduction path 3 is provided with an open/close valve a1 that is opened to introduce refrigerant into the expansion tank 2. A check valve can be incorporated in the open/close valve a1 or separately provided to prevent reverse flow through the introduction path 3. The refrigerant discharge path 4 is provided with a pressure regulating valve a2 that opens when the pressure in the expansion tank 2 reaches a specified value, for example, 9 MPa.

The system also includes a heat collecting device (heating device) 5 that absorbs heat from outside, such as a solar heat collector and a steam boiler, and is connected to an expansion turbine 7 through an open/close valve 6. The system also includes a condenser 8 for receiving vapor refrigerant exhausting from the expansion turbine 7 and cooling the vapor refrigerant by a cooling apparatus 9 to liquefy the refrigerant. The expansion tank 2 and the condenser 8 are disposed such that the level of liquid refrigerant in the expansion tank 2 is lower than that in the condenser 8. The upper part of the expansion tank 2 is connected to the upper part, i.e., a vapor zone, in the condenser via a path that branches from the upstream zone of the pressure regulating valve a2 and can include an electromagnetic valve s. A gas breeder pipe 10 having a relief valve 11 that opens when the expansion tank 2 is in a state fully filled with liquid refrigerant and its pressure reaches a specified value for letting out part of the liquid refrigerant in the expansion tank 2 to the condenser 8.

In the above system, $CO_2$ refrigerant exists in the expansion tank 2 in two phases, i.e., liquid and vapor phases, at a temperature of about 25° C. and a pressure of about 6 MPa ($P_1$ in FIG. 3), for example. That is, the refrigerant is in a state between (1) and (5) in the p-h diagram of FIG. 3. The pressure of the expansion tank 2 is decreased by cooling the refrigerant in the expansion tank 2 by a cooling apparatus C to suck liquid refrigerant into the expansion tank 2 from the condenser 8. The refrigerant in the expansion tank 2 comes to a state (1) in FIG. 3. In the p-h diagram, symbol SI is the saturated liquid line, Sy is the saturated vapor line, Tk is a constant temperature line, and K is the critical point.

By heating the $CO_2$ refrigerant in the expansion tank 2, the $CO_2$ refrigerant reaches at a state (2) in the supercritical zone or region over the critical point K passing the critical point K of 31.1° C. and 7.38 MPa. In the supercritical region, $CO_2$ is in a state of gas of high density and phase change does not occur. At this time, the open/close valve a1, the pressure regulating valve a2, and the electromagnetic valve s are all closed. It is also possible to allow the refrigerant to reach a state (2') in FIG. 3 by properly controlling the state of $CO_2$ in the expansion tank 2. When the pressure in the expansion tank 2 reaches 9 MPa ($P_2$ in FIG. 3), the pressure regulating valve 2*a* is opened (the open/close valve a1 and the electromagnetic valve s, however, are kept closed), vapor refrigerant in the expansion tank 2 is discharged into the heat collection device 5, and the vapor refrigerant is further heated in the heat collection device 5 to be brought to a state (3) of 9 MPa and 200° C.

The refrigerant vapor in the heat collection device 5 existing in the state (3) in the supercritical region is sent to the expansion turbine 7 to rotate the turbine 7 to do work W to outside, for example to rotate an electric generator. The $CO_2$ refrigerant vapor comes to a state (4) in the p-h diagram of FIG. 3 when expanded through the expansion turbine 7. Then, the $CO_2$ refrigerant is introduced into the condenser 8, cooled by the cooling apparatus 9 to be liquefied, and comes to a state (5) in the p-h diagram of FIG. 3, which is a state of wet vapor in which the refrigerant exists in two phases of gas and liquid states.

When the amount of vapor refrigerant decreases in the expansion tank 2, operation of cooling the refrigerant in the expansion tank 2 is started, and at the same time the pressure regulating valve a2, the open/close valve a1, and the electromagnetic valve s are opened. Opening the electromagnetic valve s, equalizes the pressure of the expansion tank 2 and the condenser 8, and the pressure corresponding to the difference of liquid level of liquid refrigerant between both the liquid levels in the expansion tank 2 and in the condenser 8 is applied to the expansion tank 2, since the expansion tank 2 and condenser are disposed such that the liquid level in the expansion tank 2 is lower than that in the condenser 8.

The pressure decreases in the expansion tank 2 as the refrigerant in the expansion tank 2 is cooled by the cooling apparatus C, and the liquid refrigerant in the condenser 8 is sucked into the expansion tank 2. The $CO_2$ refrigerant in the expansion tank 2 come to the state (1) in FIG. 3. Then, the liquid refrigerant in the expansion tank 2 is heated by the heating apparatus H to repeat the cycle.

A heat source from the Rankine cycle system or an outside heat source can be used as a heat source for the heating apparatus H in the expansion tank 2. For example, it is possible to use part of the heat extracted from the heat collection device 5 or part of the heat source for operating the cycle or part of electric power generated by an electric generator driven by the expansion turbine.

A cold source from the Rankine cycle system or an outside cold source can be used as a cold source for the cooling apparatus C in the expansion tank 2. For example, it is possible to use part of a cold fluid medium of an outside refrigerating cycle or part of the cold fluid medium used for the cooling apparatus 9 in the condenser 8. Part of the cold fluid medium used for cooling the refrigerant in the condenser 8 can be used as a cold source for the cooling apparatus.

By adopting the heat pump 1, means for pressurizing and transferring refrigerant vapor can be provided without using any mechanical moving components, resulting in no mechanical loss in contrast to conventional mechanical pumps. As the heat pump 1 has no moving parts and is compact in structure, it advantageously has no mechanical loss to increase the system efficiency without any need for maintenance work. This increases the reliability.

As the upper part of the expansion tank 2 is connected to the upper part of the condenser 8 via the electromagnetic valve s, inside pressure of the expansion tank 2 can be decreased rapidly to the pressure in the condenser by opening the electromagnetic valve s. As a result, suction of liquid refrigerant into the expansion tank 2 can be made easy. Thus, the pressure in the closed vessel can be decreased rapidly when introducing liquid refrigerant to the closed vessel. The pressure in the vessel is further decreased by cooling the refrigerant in the vessel so that the liquid refrigerant is introduced to the vessel with ease.

Further, as the level of liquid refrigerant in the expansion tank 2 is lower than that of the liquid refrigerant in the condenser, liquid pressure corresponding to the difference of liquid level between the liquid levels in the expansion tank 2 and condenser 8 is applied to the expansion tank 2, and suction of liquid refrigerant into the expansion tank 2 is made easy.

A liquid reservoir (not illustrated) can be provided in a zone downstream from the condenser 8 in the refrigerant introducing path such that the surface level of the liquid refrigerant in the tank 2 is lower than that of the refrigerant in the liquid reservoir. By providing the liquid reservoir, the pressure corresponding to the difference between the surface levels is applied to the tank 2, which helps the flow of refrigerant from the condenser into the tank 2.

By disposing a plurality of the heat pumps 1 in parallel and operating them such that cooling by the cooling apparatus C and heating by the heating apparatus H of the heat pumps are performed in a timed sequence (with time difference respectively in each heat pump), total flow of vapor refrigerant discharged from the heat pumps can be smoothed.

Figure 4:
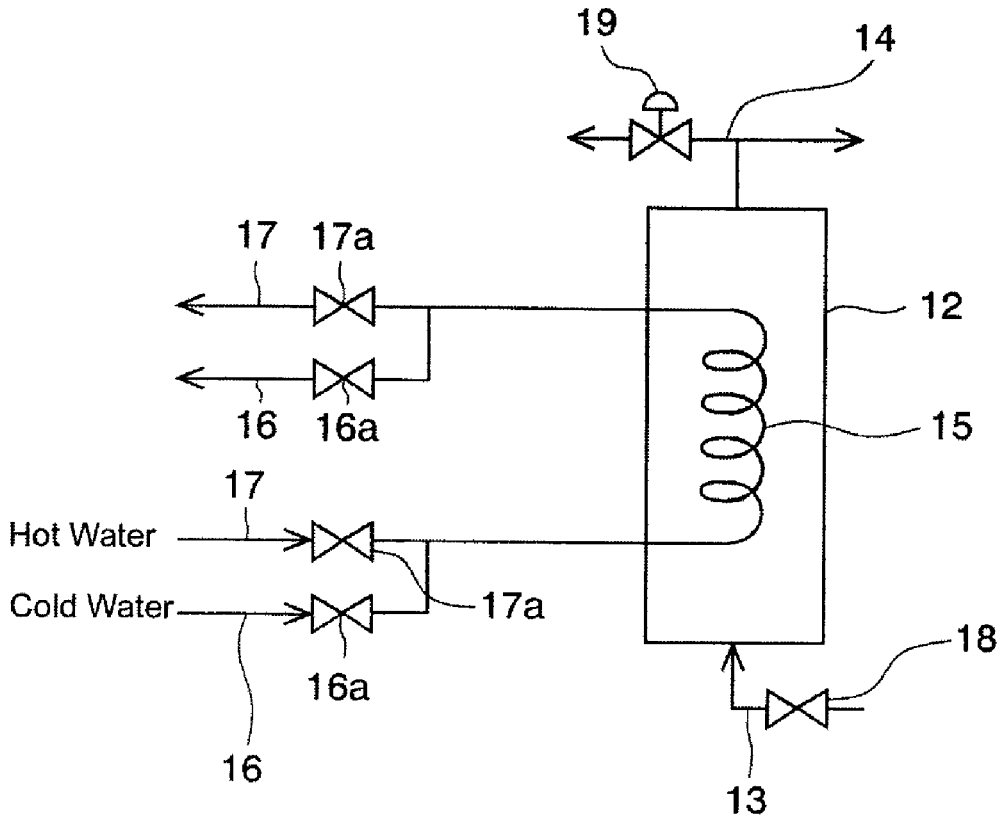
FIG. 4 is a schematic diagram of another embodiment of a transcritical Rankine system using $CO_2$ as a refrigerant.

FIG. 4 is a schematic diagram illustrating another embodiment of a heat pump usable in the Rankine cycle system of FIG. 2. An expansion tank 12 is provided with a temperature control device 15, which is connected a low temperature conduit 16 and a high temperature conduit 17. Flow of hot fluid medium and cold fluid medium to the temperature control device 15 can be switched using valves 16*a* and 17*a*. An open/close valve 18 is disposed in a refrigerant introduction path 13 of the expansion tank 12 and a pressure regulating valve 19 is disposed in a refrigerant vapor discharge path 14 of the expansion tank.

In the embodiment of FIG. 4, cold water is allowed to flow through the temperature control device 15 by opening the valves 16 when cooling the refrigerant in the expansion tank 12, and hot water is allowed to flow through the temperature control device 15 by opening the valves 17 when heating the refrigerant in the expansion tank 12 to vaporize the refrigerant. In this manner, pumping action is performed as is done in the embodiment of FIG. 2.

In the embodiment of FIG. 4, a pump can be provided in the refrigerant introduction path 13 instead of the open/close valve 18 and a connection pipe for returning refrigerant from the expansion tank to the condenser can be provided to reduce time for introducing liquid refrigerant to the expansion tank 12. By extending the refrigerant discharge path 14 to a position below the surface of the liquid refrigerant accumulating in the expansion tank 12, the apparatus can be applied to the case where liquid refrigerant below the critical pressure (7.38 MPa) is discharged through the discharge path 14.

According to the present invention, a pumping function can be realized without using moving components, and therefore without any mechanical loss associated therewith, with a compact construction and a high system efficiency, and further with a high reliability without requiring maintenance work.

Operation of the heat pump is possible even when the closed vessel is fully filled with a refrigerant in liquid state. FIG. 1 shows a liquid or vapor refrigerant at 25° C. introduced into the closed vessel. When the liquid or vapor refrigerant is heated to pressurize the closed vessel to 9 MPa, with a volume of 1 $m^3$ being assumed for the closed vessel, the refrigerant is discharged from the closed vessel. It is desirable from the point of view of safety that the closed vessel be not fully filled with a refrigerant in liquid state. It is recognized from the table shown in FIG. 1 that the amount of heat used is larger when the closed vessel is filled with a vapor refrigerant than when the closed vessel is filled with a liquid refrigerant with nearly the same amount of discharge of refrigerant from the vessel. Therefore, equipment and expense increase, as well as the operation time, when a vapor refrigerant is heated and fully gasified in the closed vessel.

When the amount (mass) of refrigerant filled in the vessel is the same for both the liquid refrigerant and the vapor refrigerant, the liquid refrigerant is advantageous because the pumping efficiency is higher (charging rate of liquid refrigerant is 100%) and the amount of discharge of refrigerant per batch discharge is larger. Nonetheless, a problem arises when a super cooled liquid refrigerant is discharged from the vessel at the start of discharge while it is being further heated in the downstream zone due to accumulation of liquid refrigerant and load variation. On the other hand, when the refrigerant is in a vapor state in the vessel, pumping efficiency is lower (charging rate of liquid refrigerant is several dozen %), but no problem results from discharging a super critical refrigerant vapor from the vessel.

The vessel is filled with the refrigerant in liquid state and pressurized in normal temperatures. The closed vessel can be a storage tank or gas bomb used under normal temperatures. For example, in a $CO_2$ bomb, 90% is liquid at 15° C., 100% is liquid at 22° C. The pressure in the bomb rises steeply until 31° C., and it reaches 12 MPa at 35° C., which pressure is determined as the maximum permissible pressure. This can be thought to be a criterion for safety of a storage tank used under normal temperatures. A relief valve that opens when the pressure in the closed vessel exceeds a specified pressure during heating operation in the case the closed vessel is fully filled with liquid refrigerant can be provided for safety.

According to the present invention, means for pressurizing and transferring a refrigerant, i.e., a pump, has no moving parts. Thus, it induces no mechanical loss that appears in conventional mechanical pumps. The pumping function can be achieved by cooling refrigerant in a closed vessel to below its saturation temperature to lower the pressure in the closed vessel to suck additional refrigerant into the closed vessel through the introduction path by virtue of pressure difference between the source of refrigerant and the closed vessel.

Thereafter, the refrigerant in the closed vessel is heated and vaporized. When the closed vessel reaches a predetermined pressure, the vapor refrigerant is discharged to a heat collecting device for example.

A heat source among heat sources inside or outside of the Rankine cycle system can be used as a heat source. As heat sources inside the Rankine cycle system, part of heat obtained in the heating device, such as a solar heat collecting device or steam boiler can be used, or part of work obtained by the expansion turbine can be used, for example. It is possible to utilize a cold source among cold sources inside or outside of the Rankine cycle system. It is also suitable to use part of cold source for condensing refrigerant vapor in the condenser as a cold source needed inside the Ranking cycle system.

By connecting the upper part of the closed vessel to a line via an open/close valve so that pressure in the closed vessel can be decreased by opening the open/close valve to a pressure at which liquid refrigerant can be introduced into the closed vessel through the refrigerant introduction path, the suction of liquid refrigerant into the closed vessel can be made easy, liquid refrigerant remaining in the closed vessel can be let out without delay, and further cooling load in the closed vessel can be reduced. When the present heat pump is used in the Ranking cycle system, the vapor zone in its condenser can be communicated to the vapor zone in the closed vessel by the open/close valve. The heat pump can feed the refrigerant by vaporizing the refrigerant that has been liquefied in the condenser to raise the pressure. A plurality of heat pumps can be operated in a timed sequence.

While the present invention has been particularly shown and described with reference to preferred embodiments thereof, it will be understood by those skilled in the art that the foregoing and other changes in form and details can be made therein without departing from the spirit and scope of the present invention. All modifications and equivalents attainable by one versed in the art from the present disclosure within the scope and spirit of the present invention are to be included as further embodiments of the present invention. The scope of the present invention accordingly is to be defined as set forth in the appended claims.

What is claimed is:

1. A pump apparatus comprising:

a closed vessel;

a refrigerant introduction path connected to the vessel at a lower part of the vessel;

a valve disposed in the refrigerant introduction path;

a refrigerant discharge path connected to the vessel at an upper part of the vessel;

a pressure regulating valve disposed in the refrigerant discharge path that opens at a predetermined pressure;

a temperature regulating device for heating and cooling a refrigerant into the closed vessel; and a conduit connecting to the refrigerant discharge path or to the upper part of the closed vessel and a valve for decreasing the pressure in the closed vessel and allowing introduction of the refrigerant into the closed vessel through the conduit;

wherein the temperature regulating device includes a cooling apparatus disposed inside the closed vessel in an upper region of the closed vessel, and a heating apparatus disposed inside the closed vessel in a lower region of the closed vessel.

2. A heat pump according to claim 1, further including a liquid reservoir connected to the refrigerant introduction path and disposed such that the surface level of the liquid refrigerant in the closed vessel is lower than that of the liquid refrigerant in the liquid reservoir.

3. A pump apparatus comprising:

a closed vessel;

a refrigerant introduction path connected to the vessel at a lower part of the vessel;

a valve disposed in the refrigerant introduction path;

a refrigerant discharge path connected to the vessel at an upper part of the vessel;

a pressure regulating valve disposed in the refrigerant discharge path that opens at a predetermined pressure;

a temperature regulating device for heating and cooling a refrigerant into the closed vessel; and a conduit connecting to the refrigerant discharge path or to the upper part of the closed vessel and a valve for decreasing the pressure in the closed vessel and allowing introduction of the refrigerant into the closed vessel in the conduit;

wherein the temperature regulating device regulates flow of a hot fluid medium and a cold fluid medium through the closed vessel.

4. A heat pump according to claim 3, further including a liquid reservoir connected to the refrigerant introduction path and disposed such that the surface level of the liquid refrigerant in the closed vessel is lower than that of the liquid refrigerant in the liquid reservoir.

5. A Rankine cycle system comprising:

a condenser;

a heat pump connected to the condenser;

a heat collecting device connected to the heat pump; and an expansion turbine connected to the heat collecting device and the condenser so that a refrigerant is introduced from the heat collecting device to the turbine to allow the turbine to output work, wherein the heat pump comprises:

a closed vessel;

a refrigerant introduction path connected to the vessel at a lower part of the vessel and connected to the condenser;

an open/close valve disposed in the refrigerant introduction path;

a refrigerant discharge path connected to the vessel at an upper part of the vessel and connected to the heat collecting device;

a pressure regulating valve disposed in the refrigerant discharge path that opens at a predetermined pressure; and a temperature regulating device for heating and cooling the refrigerant in the closed vessel.

6. A Rankine cycle system according to claim 5, wherein the temperature regulating device includes a cooling apparatus disposed inside the closed vessel in an upper region of the closed vessel, and a heating apparatus disposed inside the closed vessel in a lower region of the closed vessel.

7. A Rankine cycle system according to claim 5, wherein the temperature regulating device regulates flow of a hot fluid medium and a cold fluid medium through the closed vessel.

8. A Rankine cycle system according to claim 6, wherein a vapor zone in the condenser is communicable with a vapor zone in the closed vessel when the open/close valve is opened.

9. A Rankine cycle system according to claim 7, wherein a vapor zone in the condenser is communicable with a vapor zone in the closed vessel when the open/close valve is opened.

10. A Rankine cycle system according to claim 6, wherein a plurality of the heat pumps are arranged in parallel to allow cooling and heating of the refrigerant in the closed vessel by operating the heat pumps in a timed sequence so that total flow of refrigerant discharged from the heat pumps is smoothed.

11. A Rankine cycle system according to claim 7, wherein a plurality of the heat pumps are arranged in parallel to allow cooling and heating of the refrigerant in the closed vessel by operating the heat pumps in a timed sequence so that total flow of refrigerant discharged from the heat pumps is smoothed.

12. A Rankine cycle system according to claim 6, further including a liquid reservoir in a zone downstream from the condenser such that the surface level of the liquid refrigerant in the closed vessel is lower than that of the refrigerant in the liquid reservoir.

13. A Rankine cycle system according to claim 7, further including a liquid reservoir provided in a zone downstream from the condenser such that the surface level of the liquid refrigerant in the closed vessel is lower than that of the refrigerant in the liquid reservoir.

14. A method of pumping a refrigerant comprising the steps of:

providing a closed vessel;

providing a refrigerant introducing path at a lower part of the vessel;

providing an open/close valve in the refrigerant introduction path;

providing a refrigerant discharge path at an upper part of the vessel;

providing a pressure regulating valve in the refrigerant discharge path that opens at a predetermined pressure; and providing a temperature regulating device for heating and cooling the refrigerant in the closed vessel, wherein the refrigerant in liquid state is introduced into the closed vessel through the refrigerant introduction path by reducing the pressure inside the closed vessel by cooling the refrigerant in the closed vessel to below the saturation temperature, and wherein the refrigerant in the closed vessel is discharged through the refrigerant discharge path by vaporizing the refrigerant in the closed vessel by heating when the pressure in the closed vessel reaches the predetermined pressure.

15. A method according to claim 14, wherein after the vapor refrigerant is discharged from the closed vessel, the refrigerant remaining in the closed vessel is cooled to lower the pressure in the closed vessel, which results in the liquid refrigerant being introduced into the closed vessel through the refrigerant introduction path.

* * * * *

UNITED STATES PATENT AND TRADEMARK OFFICE

CERTIFICATE OF CORRECTION

PATENT NO. : 7,530,235 B2
APPLICATION NO. : 11/686857
DATED : May 12, 2009
INVENTOR(S) : Yamaguchi et al.

It is certified that error appears in the above-identified patent and that said Letters Patent is hereby corrected as shown below:

Please delete paragraphs [0001], [0002] and [0003], column 1, lines 5-40

"The system also includes a heat collecting device (heating device) 5 that absorbs heat from outside, such as a solar heat collector and a steam boiler, and is connected to an expansion turbine 7 through an open/close valve 6. The system also includes a condenser 8 for receiving vapor refrigerant exhausting from the expansion turbine 7 and cooling the vapor refrigerant by a cooling apparatus 9 to liquefy the refrigerant. The expansion tank 2 and the condenser 8 are disposed such that the level of liquid refrigerant in the expansion tank 2 is lower than that in the condenser 8. The upper part of the expansion tank 2 is connected to the upper part, i.e., a vapor zone K as shown in Fig. 2, in the condenser via a path that branches from the upstream zone of the pressure regulating valve a2 and can include an electromagnetic valve s. A gas breeder pipe 10 having a relief valve 11 that opens when the expansion tank 2 is in a state fully filled with liquid refrigerant and its pressure reaches a specified value for letting out part of the liquid refrigerant in the expansion tank 2 to the condenser 8.

Figure 6:
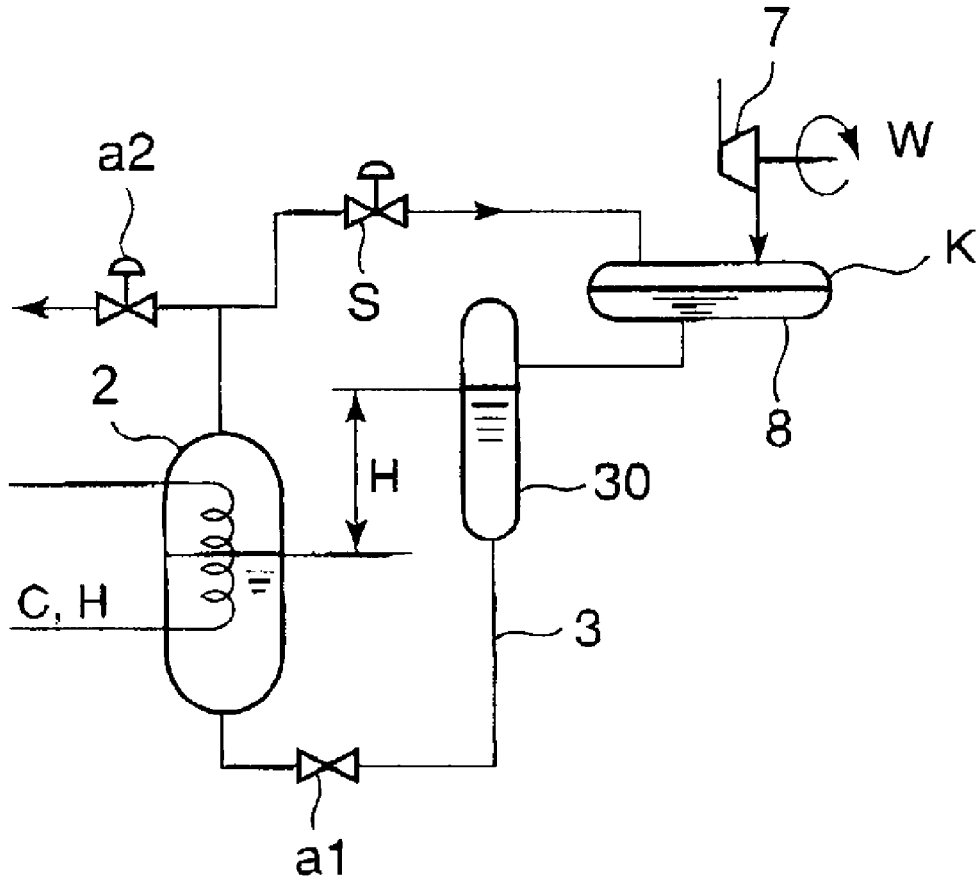
FIG. 6 illustrates an embodiment of the invention that includes a liquid refrigerant reservoir.

A liquid reservoir 30 can be provided in a zone downstream from the condenser 8 in the refrigerant introducing path as shown in Fig. 6, such that the surface level of the liquid refrigerant in the tank 2 is lower than that of the refrigerant in the liquid reservoir. By providing the liquid reservoir 30, the pressure corresponding to the difference between the surface levels is applied to the tank 2, which helps the flow of refrigerant from the condenser into the tank 2.

Figure 5:
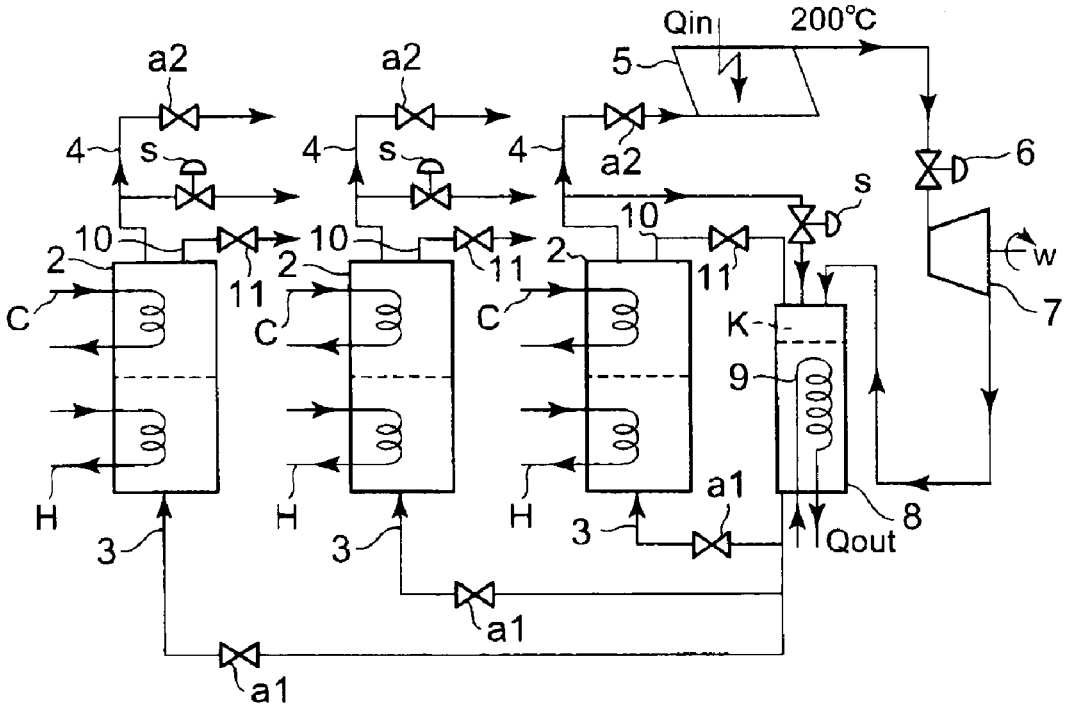
FIG. 5 illustrates a plurality of pumps of the type illustrated in FIG. 2 in parallel.

By disposing a plurality of the heat pumps 1 in parallel as shown in Fig. 5, and operating them such that cooling by the cooling apparatus C and heating by the heating apparatus H of the heat pumps are performed in a timed sequence (with time difference respectively in each heat pump), total flow of vapor refrigerant discharged from the heat pumps can be smoothed."

Column 1, lines 5 to 40, please insert the following:

--This is a continuation of International Application PCT/JP2005/016834 (published as WO 2006/030779) having an international filing date of 13 September 2005, which claims priority to JP 2004-272597 filed 17 September 2004. The disclosure of the priority application, in its entirety, including the drawings, claims, and the specification thereof, is incorporated herein by reference.

It is certified that error appears in the above-identified patent and that said Letters Patent is hereby corrected as shown below:

In a supercritical Rankine cycle system and the like that uses CO2 as a refrigerant, a pressurizing device, namely a mechanical liquid pump, is used to pressurize the refrigerant, which has been liquefied in a condenser, to a supercritical pressure. The mechanical pump is driven by an external power source or part of the power obtained from the system. See for example, Japanese Laid-Open Patent Application Nos. 2003-232226 and 2004-36942, where a mechanical pump is used to pressurize and feed the refrigerant in the Rankine cycle system.

Mechanical pumps, however, induce mechanical loss resulting in a lowered cycle efficiency. Further, as mechanical pumps have moving components, reliability of the system is reduced, as well as requiring regular replacement of components. Replacing such devices operating at a high pressure accompanies great difficulties, increasing the maintenance cost. Furthermore, increased pumping power is needed to raise pressure of working fluid up to the critical pressure.--

Please delete paragraph [0023], column 3, lines 50-67

"The system also includes a heat collecting device (heating device) 5 that absorbs heat from outside, such as a solar heat collector and a steam boiler, and is connected to an expansion turbine 7 through an open/close valve 6. The system also includes a condenser 8 for receiving vapor refrigerant exhausting from the expansion turbine 7 and cooling the vapor refrigerant by a cooling apparatus 9 to liquefy the refrigerant. The expansion tank 2 and the condenser 8 are disposed such that the level of liquid refrigerant in the expansion tank 2 is lower than that in the condenser 8. The upper part of the expansion tank 2 is connected to the upper part, i.e., a vapor zone, in the condenser via a path that branches from the upstream zone of the pressure regulating valve a2 and can include an electromagnetic valve s. A gas breeder pipe 10 having a relief valve 11 that opens when the expansion tank 2 is in a state fully filled with liquid refrigerant and its pressure reaches a specified value for letting out part of the liquid refrigerant in the expansion tank 2 to the condenser 8."

Please insert in place thereof:

--The system also includes a heat collecting device (heating device) 5 that absorbs heat from outside, such as a solar heat collector and a steam boiler, and is connected to an expansion turbine 7 through an open/close valve 6. The system also includes a condenser 8 for receiving vapor refrigerant exhausting from the expansion turbine 7 and cooling the vapor refrigerant by a cooling apparatus 9 to liquefy the refrigerant. The expansion tank 2 and the condenser 8 are disposed such that the level of liquid It is certified that error appears in the above-identified patent and that said Letters Patent is hereby corrected as shown below:

refrigerant in the expansion tank 2 is lower than that in the condenser 8. The upper part of the expansion tank 2 is connected to the upper part, i.e., a vapor zone K as shown in Fig. 2, in the condenser via a path that branches from the upstream zone of the pressure regulating valve a2 and can include an electromagnetic valve s. A gas breeder pipe 10 having a relief valve 11 that opens when the expansion tank 2 is in a state fully filled with liquid refrigerant and its pressure reaches a specified value for letting out part of the liquid refrigerant in the expansion tank 2 to the condenser 8.--

Please delete paragraphs [0034] and [0035], column 5, lines 35-48

"A liquid reservoir (not illustrated) can be provided in a zone downstream from the condenser 8 in the refrigerant introducing path such that the surface level of the liquid refrigerant in the tank 2 is lower than that of the refrigerant in the liquid reservoir. By providing the liquid reservoir, the pressure corresponding to the difference between the surface levels is applied to the tank 2, which helps the flow of refrigerant from the condenser into the tank 2.

By disposing a plurality of the heat pumps 1 in parallel and operating them such that cooling by the cooling apparatus C and heating by the heating apparatus H of the heat pumps are performed in a timed sequence (with time difference respectively in each heat pump), total flow of vapor refrigerant discharged from the heat pumps can be smoothed."

Please insert in place thereof:

--A liquid reservoir 30 can be provided in a zone downstream from the condenser 8 in the refrigerant introducing path as shown in Fig. 6, such that the surface level of the liquid refrigerant in the tank 2 is lower than that of the refrigerant in the liquid reservoir. By providing the liquid reservoir 30, the pressure corresponding to the difference between the surface levels is applied to the tank 2, which helps the flow of refrigerant from the condenser into the tank 2.

UNITED STATES PATENT AND TRADEMARK OFFICE

CERTIFICATE OF CORRECTION

PATENT NO. : 7,530,235 B2
APPLICATION NO. : 11/686857
DATED : May 12, 2009
INVENTOR(S) : Yamaguchi et al.

It is certified that error appears in the above-identified patent and that said Letters Patent is hereby corrected as shown below:

By disposing a plurality of the heat pumps 1 in parallel as shown in Fig. 5, and operating them such that cooling by the cooling apparatus C and heating by the heating apparatus H of the heat pumps are performed in a timed sequence (with time difference respectively in each heat pump), total flow of vapor refrigerant discharged from the heat pumps can be smoothed.--

Signed and Sealed this

Eleventh Day of August, 2009

David J. Kappos

David J. Kappos
*Director of the United States Patent and Trademark Office*